United States Patent [19]

Douche et al.

[11] Patent Number: 4,807,814

[45] Date of Patent: Feb. 28, 1989

[54] PNEUMATIC POWDER EJECTOR

[75] Inventors: Jean-Pierre Douche, Thourotte; Jean-Claude Coulon, Mercurey; Claude Bernard, Livry-Gargan, all of France

[73] Assignee: Saint Gobain Vitrage, Courbevoie, France

[21] Appl. No.: 815,973

[22] Filed: Jan. 3, 1986

[30] Foreign Application Priority Data

Jan. 4, 1985 [FR] France ..... 85 00072

[51] Int. Cl.[4] ..... F04F 5/00

[52] U.S. Cl. ..... 239/428; 417/174; 406/153

[58] Field of Search ..... 239/431, 434.5, 429, 239/428, 600, 653, 654, 8, 10, 428.5; 406/93-95, 153, 194; 417/174

[56] References Cited

FOREIGN PATENT DOCUMENTS

| | | | |
|---|---|---|---|
| 488231 | 12/1927 | Fed. Rep. of Germany . | |
| 2171686 | 3/1975 | France . | |
| 2333579 | 7/1977 | France . | |
| 2416786 | 9/1979 | France . | |
| 2542636 | 5/1983 | France . | |
| 2548556 | 7/1983 | France . | |
| 153905 | 2/1982 | German Democratic Rep. | 417/174 |
| 422328 | 4/1982 | U.S.S.R. | 417/174 |
| 1564229 | 4/1980 | United Kingdom . | |

*Primary Examiner*—Andres Kashnikow
*Assistant Examiner*—Kevin P. Weldon
*Attorney, Agent, or Firm*—Pennie & Edmonds

[57] ABSTRACT

The invention is in a pneumatic powder ejector comprising a suction stage and an injection stage. The suction stage includes a suction chamber (16), a venturi (14) communicating a primary gas to the suction chamber and a lateral suction input (18) offset in relation to the downstream end of the venturi. The injection stage includes a nozzle (22), an injection chamber (36) and a diffuser (38). The stages are located within a coaxially of the body of a tubular ejector. The nozzle includes a path for powder and primary gas between the suction chamber and diffuser, and is formed to provide a flow path of reduced dimension to communicate a secondary or entrainment gas between the diffuser and injection station.

16 Claims, 2 Drawing Sheets

PNEUMATIC POWDER EJECTOR

TECHNICAL FIELD

This invention relates to a pneumatic ejector capable of suctioning and entraining a powder in a carrier fluid, such as air. The pneumatic ejector operates in a manner whereby the air/powder suspension has substantially a constant powder concentration for deposit in an even distribution on a substrate, such as a glazing. The substrate may be moved in relation to the pneumatic ejector and the deposit will be in the form of a film of powder or the product resulting from its decomposition.

BACKGROUND OF THE INVENTION

Glazings having certain electrical, thermal or optical characteristics used as a heating glazing or an optical element, for example, are known. It is also known that glazings or optical elements may be provied these characteristics by coating the glazing with a metal oxide layer obtained by high temperature decomposition, followed by oxidation of a compound initially in the form of a powder distributed on the heated glazing or optical element. If the characteristics are to be uniform over the entire surface, it is necessary that any variation in thickness of the layer be as small as possible. In practice, the variation should not exceed 1% of the nominal thickness. Accordingly, as may be appreciated, the powder should be distributed with great precision.

A plate metering device providing an output in the form of a continuous, constant flow of powder in a disagglomerated and practically fluidized form is known and has been successfully used in such distribution. Such a metering device is described in French patent application No. 85 00052. As described, powder extracted at the output of the metering device is distributed on a substrate. The extraction and distribution is carried out in a manner to avoid, the extent possible, any compacting of powder during its transfer. If this precaution were not taken, irregularities in the thickness of the layer, reflected by anomalies in appearance, or in the optical, electrical and/or thermal properties, would be observed.

The extraction of the powder and its distribution on a substrate can be achieved by pneumatic ejectors. Several techniques and uses of the ejectors of the air jet type including a suction cone connected to its narrow end to the input opening of a tubular injector body are known. This form of ejector may include an injector body having an intake through which air for the entrainment of powder is injected. The intake may be located laterally of the body for communication into an annular chamber provided with a narrow annular gap. The annular gap may be located between an input opening and the end of a nozzle extending along the axis of the suction cone.

The injected air, at the gap output, comes out at the speed of sound creating a negative pressure at a nozzle input. Since the cone input is at atmospheric pressure, that is, it is not the situs of any negative pressure, a suction flow will be induced in both the cone and nozzle. The induced flow generally will be on the order of about 50% of the injected flow. With the high volumetric efficiency and almost a zero negative pressure at the input, it may be seen that the ejector will behave like a veritable amplifier with regard to disturbances that may be produced in the suctioned powder flow. The suctioned powder, itself, may act as an exciter. Thus, a disturbance at the input, for example, a variation in the concentration of powder in the suctioned mixture will be amplified and it will become more intense at the output with little opportunity for control. An ejector of this type, quite obviously, is unstable and not suitable for the fabrication of substrates coated with fine layers of material. Ths is particularly the case under circumstances that a desired precision of less than 1% is to be maintained.

Another form of ejector including an injection stage consisting of a venturi, and a suspension stage comprising an axial extension of the venturi is also known. This ejector functions by means of a suction of primary air and the mixture of air and powder within an input whose axis not only is perpendicular to that of the venturi but also comes out at the level of the nose of the venturi.

An ejector of this type permits a build up of great negative pressure at the input with only a slight flow. While the ejector is quite stable and, it would appear quite suitable for entraining the powder as a suspension in an air carrier, the range of stability of the ejector is very narrow. Further since the range of stability is imposed by the diameter of the venturi it cannot be modified for a given injector. Further still, the flow delivery is extremely low. Finally, the ejector runs the risk of clogging of powder and the powder layer that is formed on the venturi causes destabilization of the ejector when it becomes thick enough. This condition is thought to arise because of the location of the venturi nose in the path of the suctioned air-powder mixture.

SUMMARY OF THE INVENTION

The invention is in a pneumatic ejector which overcomes the disadvantages and deficiencies of the prior art. Particularly, the pneumatic ejector of the invention has an increased suction negative pressure capacity and an increased nominal flow rate at deliver. The increases are great in comparison with the prior art, and the increases may be adjusted to obtain an atmospheric suction flow which is as low as possible in relation to the total delivered flow to relativize any disturbance introduced by extraction of powder.

These aims have been successfully attained according to the invention by making independent the suction of the powder and injection of the suspension carrier fluid.

According to the invention, the pneumatic ejector may be characterized by a suction stage and an injection stage. The suction stage includes a venturi fitted to the input end of a tubular injector body, and a suction input located laterally of the venturi, at an offset relation to the downstream end of the venturi. A primary gas is injected through the venturi and the input end of the tubular body.

The injection stage comprises a nozzle within the tubular injector body, and a diffuser at the output of the tubular body. Both the nozzle and diffuser are located in coaxial disposition downstream of the suction stage.

The nozzle comprises a flared tubular head and a tubular portion which is tapered toward its output end. The flared tubular head provides a mount for the nozzle within the tubular injector body. An injection chamber into which an entrainment gas can be injected is located within the region between the nozzle and peripheral wall of the body. The entrainment gas is introduced through orifices drilled in the peripheral wall.

The diffuser includes an inside wall shaped to be first convergent and then divergent from a zone of minimal section. The diffuser is positioned within the injector body so that the zone of minimal section is at right angles to the output end of the tubular portion of the nozzle. Thus, the zone of minimal section and the output nozzle end define a narrow annular gap for the passage of the gas from the injection chamber.

Advantageously, the length of the tapered tubular portion of the nozzle is at least equal to eight times the inside diameter of the nozzle. The length of the tapered tubular portion allows for a calming of the gas/powder mixture.

According to the embodiments of the invention, the suction input may open into the suction chamber at a location either slightly beyond the downstream end of the venturi or upstream from the downstream end of the venturi. Irrespective of the location of the suction input, operation of the suction stage and the injection stage will be totally independent, one from the other. This independently makes it possible to modify the suction flow without imposing any modification whatever on the total flow delivered. Thus, it will be easy to adjust the flows to obtain optimal ejection conditions. Particularly, it will be easy to provide a sufficient negative pressure for suction of the powder with an atmospheric flow, in relation in the total flow delivered, that is as low as possible so as to avoid compacting of the powder. Further, the disturbance introduced by extraction of the powder may be made negligible, and a high nominal flow for delivery of the suspension may be achieved.

It is also advantageous to associated the pneumatic ejector of the invention with a powder feed system as described in U.S. application Ser. No. 815,972, filed Jan. 3, 1986 and incorporated herein by reference. Such a system includes a plate metering device, the output of which, it has been found, may be connected to the lateral suction input of the ejector.

The various embodiment of the invention will be described in detail as the description to be read in conjunction with a reference to the accompanying drawing continues.

BEST MODE FOR CARRYING OUT THE INVENTION

Figure 1:
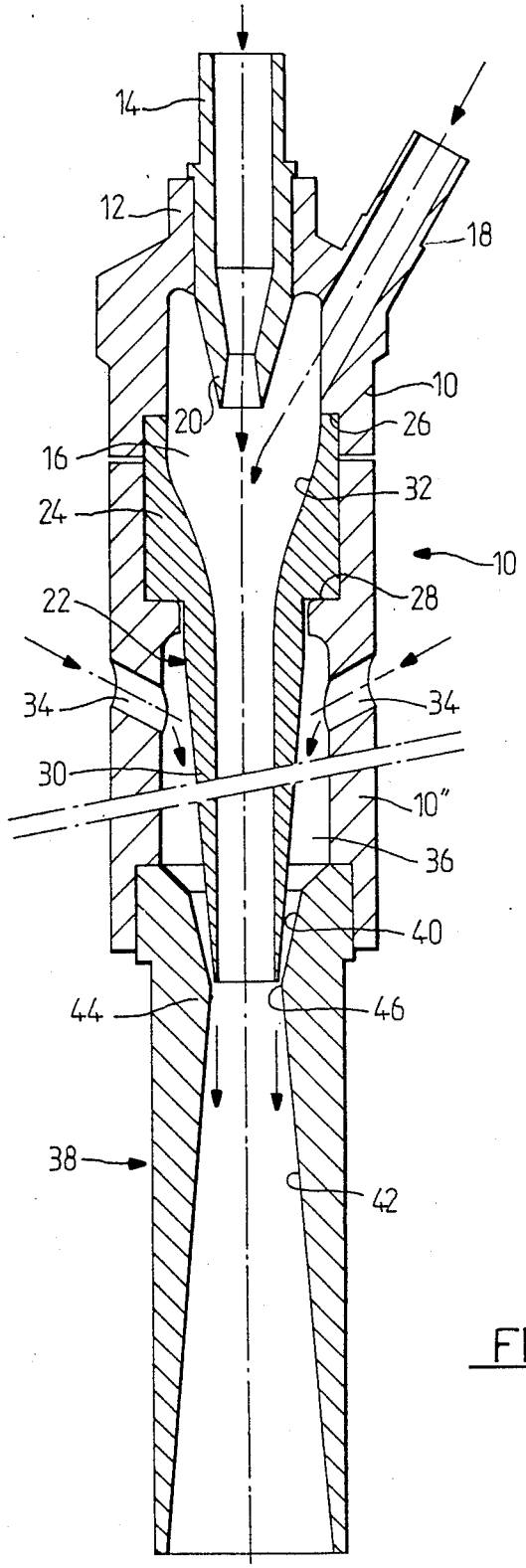
FIG. 1 is a view in section of the pneumatic ejector according to a first form of the invention.

Referring to FIG. 1, the pneumatic ejector is represented by a body 10 including body sections 10' and 10''. The body is tubular in outline and the body sections are located in end-to-end relation. Body portion 10' includes a sleeve 12 and an end 18. A venturi 14 is fastened coaxially within the sleeve in any known manner. The venturi 14 serves as a source for injecting a primary gas into a suction chamber 16 located within body portion 10'. The end 18 of body portion 10' is provided to mount a tube (not shown) or ingress of powder. The end is located to extend substantially laterally from the wall of the body portion and the powder is suctioned from a powder metering device, for example, from the feed system previously discussed. In FIG. 1 the end is inclined in relation to the axis of body 10 and venturi 14 in the direction of flow of the primary gas. The end has an outlet within the suction chamber 16, and offset slightly downstream in relation to nose 20 of venturi 14. In this manner, the suctioned powder will not deposit on the nose 20 of the venturi 14. Further, the outlet from end 18 is located in a zone where the gas streams are stabilized. To this end, the outlet from the end may be located within the region or zone of suction chamber 16 wherein the inner wall formed by a nozzle 22 either converges in the direction of flow of primary gas or is constant.

Body portion 10', end 18, venturi 14, and suction chamber 16 form the suction stage of the pneumatic ejector.

Body portions 10' and 10'' may be connected in any manner. For example, with continued reference to FIG. 1, the connection may be assured by the construction of a nozzle 22 located coaxially within the body portions. To this end, the nozzle comprises a flared head 24 housed within an annular cutout region between shoulders 26,28 formed on the inside edges of the juxtaposed body portions 10' and 10'', respectively. The connection may be an interference connection, or the nozzle and body portions may be secured by machine screws or the equivalent.

Nozzle 22 also includes a tubular portion 30, located almost entirely within the confines of the body portion 10''. The tubular portion is tapered along its outside surface from the flared head 24 to its output end. The inside surface of the tubular portion is substantially cylindrical in shape. Thus, the wall thickness at the output end of the nozzle as determined by the taper of the outside surface of the tubular portion, is relatively slight.

Advantageously, the length of the tubular portion of the nozzle is at least eight times that of the inside diameter. The length dimension permits a calming of the gas and entrained powder as the gas and powder mixture move toward the output end.

The flared head 24 of nozzle 22 comprises a portion of the inside lateral wall of suction chamber 16. To this end, the nozzle includes a bore 32 which is convergent toward the input end of the tubular portion.

A plurality of orifices 34 are drilled or otherwise formed in the wall of body portion 10''. Each orifice communicates with an annular chamber 36 located between the outside surface of the tubular portion and the inner wall of the body portion. Each orifice, further, extends along an axis substantially tangent to the inner wall of the body portion for injection of entrainment peripheral gas into the chamber.

A diffuser 38 is connected axially at the outer end of body portion 10''. The inside wall of the diffuser is convergent along a length 40, and divergent from a zone of maximum constriction 44 along a length 42. A further length, upstream of the first-mentioned portion, has a greater angle of convergency so that it exhibits a section equal to the inside diameter of body portion 10''. The zone of maximum constriction is slightly greater in section than the outside section of the output end of the tubular portion. The sections are at right angles and provide a narrow annular gap 46 for passage of the peripheral gas along the divergent length of diffuser 38.

Body portion 10'' and nozzle 22 comprise the injection stage of the pneumatic ejector.

Figure 2:
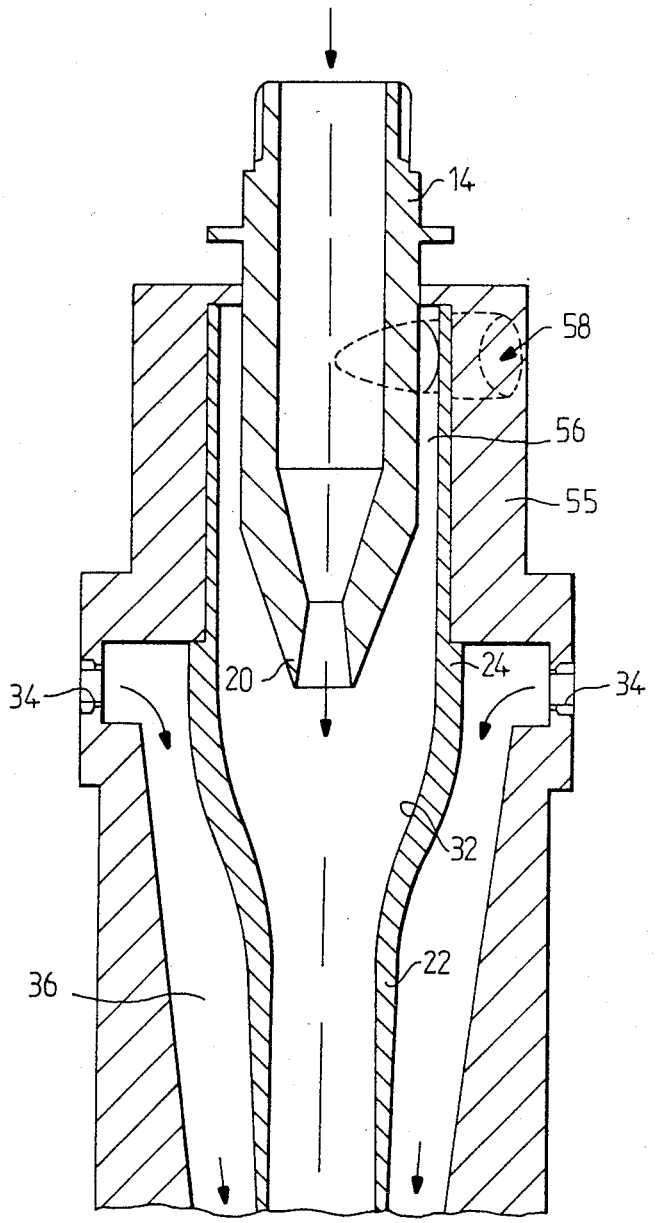
FIG. 2 is a view in section of the upper portion of a pneumatic ejector according to a second form of the invention.

Referring now to FIG. 2, there is illustrated a slightly modified variation of the upper part of the pneumatic ejector of FIG. 1. In this variant, the end 58 for ingress of powder suctioned from a powder metering device is located in offst relation to the nose 20 of venturi 14 and in a position that its outlet end is located upstream from the nose. This variant is particularly advantageous in use when it is desired to associate the pneumatic ejector with a cyclone capable of sorting powder particles as a function of their size.

In the variant of FIG. 2, a suction chamber 56 is bounded inwardly by venturi 14 and outwardly by a wall 55 of the body which surrounds the venturi. Primary gas entering the pneumatic ejector enters through venturi 14. The wall may include gas current intakes (not shown) for providing a cyclone-like effect within the suction chamber. In the manner of suction chamber 16, see FIG. 1, suction chamber 56 is connected to the flared head of the nozzle 22 of the injection stage. The nozzle of FIG. 2 is substantially unchanged from the nozzle of FIG. 1. Other parts of the ejector device remain unchanged, also.

Referring again to FIG. 2, the suction end 58 through which powder is introduced, is located in the upper reaches of the wall 55. The suction end is disposed in a tangential orientation in relation to wall 55, and optionally inclined in relation to the axis of the venturi. Optionally, a second cyclone stage may be located downstream of nose 20 of venturi 14. Under the conditions of use of the second cyclone stage wall 55 would be extended to a location beyond the nose of the venturi. Further tangential gas current intakes (not shown) may be located within the extended length of the wall. These gas currents provide an additional or second cyclone-like effect.

In a particular embodiment, the gas stream intakes and walls 55 are located and shaped to define the periphery of the flow of primary gas from venturi 14. The inside wall of suction chamber 56, downstream of the gas current intakes of the second cyclone stage, is connected to nozzle 22, all as previously described.

The pneumatic ejector will be found to operate in a manner now to be described. To this end, primary gas moves through venturi 14 and is injected into suction chamber 16 (or 56). The action of the venturi creates a negative pressure which has the effect of suctioning powder from a powder metering device into the chamber. Powder enters the suction chamber through pipe end 18 (or 58). Since the suction operation is performed at atmospheric pressure or approximately at atmospheric pressure, the powder will remain in the same uncompacted, fluid form as it existed in the metering device. Because the outlet from end 18 opens within the region or zone of suction chamber 16 at which the gas streams are stabilized, that is, within the region or zone of nozzle 22 described by either a converging wall or wall of constant inner diameter, there is little or no risk of a destabilization of the flows. Rather, there is found at this level of the ejector optional homogeneity of the gas mixture and powder. Therefore, a constant flow of finely divided powder entrained by the primary gas will flow from the suction chamber into nozzle 22. While in the nozzle, the powder and primary gas are intimately mixed to form a homogeneous suspension. The intimate mixing will take place as the gas and powder advance.

The homogeneous suspension, then, enters diffuser 38 and moves through the length 42 (see FIG. 1). This movement is imparted by the flow of peripheral gas which enters body portion 10'' through orifices 34. The flow of peripheral gas follows a path from the annular chamber 36, and communicates with the homogeneous suspension of powder and primary gas at gap 46. The peripheral gas moving through gap 46 may acquire a speed approaching speed of sound. The strongly diluted suspension of powder in the peripheral gas is sprayed on the substrate, which, as previously indicated, is moved passed the diffuser 38 at a constant speed. The substrate will be covered with a layer of powder or material resulting from the decomposition of the powder.

In the variant embodiment of FIG. 2, the pneumatic ejector is associated with a cyclone and the powder particles which can be of various sizes will undergo a veritable sorting inside said cyclone with each category of particles following a different path in movement through the nozzle, the heaviest particles taking the broadest path. At the moment when particles from the particle streams meet with the peripheral gas flow moving at high speed, the particles within their paths of movement undergo essentially great disturbance and an alteration of moement. The disturbance, and particularly the impacts between particles, cause larger particles to fragment and reduce to smaller size particles. This action results from the high speed of movement of the peripheral gas flow which, optionally, may be at sonic speed. If a second cyclone is provided at a location downstream of the first cyclone, those particles which are more course, or possibly consisting of agglomerates will ravel within a broader or wider path in the first cyclone. These particles or agglomerates not carried away by primary gas from venturi 14 will be subjected to the action of the second cyclone and fragmented within the second cyclone.

According to both variants of the invention, the stages of the pneumatic ejector including the suction stage where the suction of the powder is performed and the injection stage where the entrainment gas is injected into the flow path for powder operate completely independently of one another. To this end, the stages use different gas sources. Thus, contrary to the operation of ejectors of the prior art, previously discussed, it is possible to modify the functions of one of the stages without causing a modification of the function of the other of the stages. Thus, it is possible to adjust the ratio of the suction flow of the total delivered flow to as small a ratio as possible so that the disturbance introduced by the extraction of the powder is negligible. The stability range of the ejector, therefore, is much broader than in known ejectors. The suction negative pressure and the nominal delivery flow of the suspension can both be increased.

The pneumatic ejector of the invention may provide suspensions of constant nominal concentration, with variations not exceeding 1% of the nominal concentration, and it may provide high delivery flows, on the order of 500 to 1000 $m^3/h$.

The primary gas and entrainment gases, as well as the gas streams which serve the functioning of the cyclone associated with the pneumatic ejector of FIG. 2 may be air. It is, however, contemplated that other gases, for example, nitrogen may be used. In fact, it may be preferred to use gases other than air when the suction of the pneumatic ejector is very slight.

Such an installation permits and makes possible the dilution of small amounts of powder or particulate in large volumes of gas, with the guarantee of substantially perfect homogeneity of the mixture at each moment, and at each point of the section at the output of the ejector. An output delivery from the ejector, for example, in the range of 20 to 35 kg of powder in homogeneous suspension in 400 $Nm^3$ of gas is typical.

As previously indicated, the pneumatic injector advantageously may be used with the plate metering device disclosed in the aforementioned French application. The disclosure, as it relates to the plate metering device, is incorporated herein by reference. Briefly, however, the plate metering device is formed by an open flat-bottomed bowl which is fed with powder under atmospheric pressure conditions. The power within the bowl is mentioned at substantially a constant level and stirred with a stirrer to maintain the powder in a fluid, homogeneous condition. The bowl is disposed on the upper surface of a horizontal circular plate. The plate is driven rotationally around its axis, relative to the bowl. The upper face of the plate is smoothly planar, and a circular groove centered on the axis of the plate is formed in its upper surface. A seal having a small coefficient of friction is located between the plate and the flat bottom of the bowl. The axis of the bowl is spaced from the axis of the plate so that a portion of the length of the groove enters into the bowl. The remaining portion of the length of the groove remains outside the confines of the bowl. A suction device for suctioning powder from the groove is disposed adjacent the groove at a point along the groove outside of the bowl.

The suction device of the plate metering device comprises the ejector according to the invention. Particularly, the suction device of the plate metering device is defined by the end 18, 58 whose input orifice is located as set out above. The metering device for feeding the pneumatic ejector makes it possible to distribute a powder continuously, without compaction, and with a delivery compatible with those required by the coating application of a substrate, particularly a substrate of glass.

Advantageously, to provide a slightly more marginal input delivery of powder in suspension, the end 18, 58 also receives an additional delivery of gas, such as air. The additional delivery of air is both forced and controlled.

The metering device and ejector unit are used to feed a powder distributor, such as described in U.S. application Ser. No. 627,592, filed July 3, 1984. The powder distributor, in turn, feeds a distribution nozzle, such as described in the U.S. Pat. No. 4,562,095 to Coulon et al., issued Dec. 31, 1985.

This unit is used to make thin layers on a substrate having a thickness on the order of 0.1 to 0.2 microns, and thickness variations that can be less than 50 angstroms. The layers are made of powders, such as DBTO (dibutyltin oxide), DBTF (dibutyltin fluoride), indium formate or mixtures of these powders that are decomposable by heat.

We claim:

1. An pneumatic powder ejector for depositing a powder on a substrate comprising a body; a suction stage within said body at one end, said suction stage including a suction chamber, a venturi for communicating a flow of primary gas to said suction chamber, and an input flow path for communicating powder to be deposited to said suction chamber, said powder being entrained in air along said input flow path and further being supplied at a controlled delivery rate, said input flow path being located in lateral offset relation to a downstream end of said venturi; and an injection stage within said body extending coaxially from said suction chamber toward the end of said body opposite said suction stage, said injection stage including a nozzle surrounded by a wall with the spaced therebetween defining a flow path for powder, said wall having an outer surface supported at one end by said body and substantially spaced from said body throughout a tapered length to its opposite end, an injection chamber for supplying an entrainment gas, said injection chamber located within said body bounded by said outer surface, at least one opening in said body for communicating said entrainment gas to said injection chamber, and a diffuser supported at the end of said body opposite said suction stage, said diffuser having an inner wall including a length convergent toward a zone of minimum section and a length divergent from said zone, said zone of minimum section located substantially at said opposite end of said nozzle and forming with said nozzle a gap output from said injection chamber passage of entrainment gas into said diffuser.

2. The pneumatic powder ejector according to claim 1 wherein said body is made up of two tubular pieces received together in juxtaposed end to end relationship, each tubular piece including a groove along an inside surface at an end, said grooves forming an annular slot when said pieces are received together, and said outer surface of said nozzle having a flared annular portion received in said slot.

3. The pneumatic powder ejector according to claim 1 wherein said flow path of said nozzle is in the form of a bore whose section at said one end is substantially coextensive with that of said suction chamber and decreases progressively to a portion along the length extending to the other end of substantially constant, tubular section throughout.

4. The pneumatic powder ejector according to claim 1 wherein said flow of powder to said suction chamber is along a path whose axis is inclined in relation to the axis of the venturi in the direction of flow of the primary gas.

5. The pneumatic powder ejector according to claim 3 wherein said tubular section of said nozzle extends throughout a length to coincide substantially with said tapered length of said outer surface, said length being at least equal to eight times its inside diameter.

6. The pneumatic powder ejector according to claim 4 wherein said input flow path includes an outlet within the suction chamber upstream from the outlet end of the venturi, and wherein the axis of said input flow path extends in the direction of flow of the primary gas.

7. The pneumatic powder ejector according to claim 1 wherein said suction chamber surrounds said venturi, and said input flow path enters said suction chamber upstream from the downstream end of the venturi.

8. The pneumatic powder ejector according to claim 7 wherein said input flow path is directed tangentially in relation to the wall in entering said suction chamber.

9. The pneumatic powder ejector according to claim 1 wherein said input flow path for communicating powder includes an outlet which comes out slightly beyond the downstream end of the venturi in the direction of flow of the primary gas.

10. The pneumatic powder ejector according to claim 1 wherein said input flow path for communicating powder includes an outlet which is located in a constant-section zone of said suction chamber.

11. The pneumatic powder ejector of claim 1 for the coating of substrates, brought to high temperature, with thin layers from powders decomposable by heat in combination with a powder metering device.

12. The pneumatic powder ejector of claim 4 wherein said axis of said venturi is substantially along the axis of said body.

13. A pneumatic powder ejector for depositing a powder on a substrate, said ejector comprising:

(a) a body portion;

(b) a suction stage within said body portion at a first end, said suction stage including a suction chamber, a venturi for communicating a flow of a primary gas to said suction chamber and an input flow path for communicating powder to be deposited to said suction chamber, said suction chamber comprising a space within said body surrounding said venturi, wherein said input flow path is located in lateral offset relation to a downstream end of said venturi and further wherein said input flow path communicates with said space in the direction of flow of said primary gas; and (c) an injection stage located within said body portion, said injection stage extending coaxially from said suction chamber toward a second end of said body portion, said injection stage including (i) a nozzle with a wall defining a flow path for said powder, said wall having an outer surface supported at one end by said body and substantially spaced from said body throughout a tapered length to a second end, (ii) an injection chamber for supplying an entrainment gas, said injection chamber located within said body portion and bounded by said outer surface, (iii) said body portion defining at least one opening therein for communicating said entrainment gas to said injection chamber, and (iv) a diffuser supported at said second end of said body portion, said diffuser having an inner wall including a length convergent toward a zone of minimum section, and a length divergent from said zone, said zone of minimum section located substantially at said second end of said nozzle and forming, with said nozzle a gas outlet from said injection chamber for passage of entrainment gas into said diffuser.

14. The pneumatic powder ejector of claim 13 wherein said powder is entrained in air along said input flow path and is supplied at a controlled delivery rate.

15. In combination, (A) a pneumatic powder ejector for coating substrates heated to an elevated temperature with thin layers formed from the application thereto of heat-decomposable powders, said pneumatic powder ejector comprising:

(1) a body portion;

(2) a suction stage within said body portion at a first end, said suction stage including a suction chamber, a venturi for communicating a flow of a primary gas to said suction chamber and an input flow path for communicating powder to be deposited to said suction chamber, wherein said input flow path is located in lateral offset relation to a dowmstream end of said venturi; and (3) an injection stage located within said body portion, said injection stage extending coaxially from said suction chamber toward a second end of said body portion, said injection stage including (i) a nozzle surrounded by a wall with the space therebetween defining a flow path for said powder, said wall having an outer surface supported at one end by said body and substantially spaced from said body portion throughout a tapered length to a second end, (ii) an injection chamber for supplying an entrainment gas, said injection chamber located within said body portion and bounded by said outer surface, (iii) said body portion defining at least one opening therein for communicating said entrainment gas to said injection chamber, and (iv) a diffuser supported at said second end of said body portion, said diffuser having an inner wall including a length convergent toward a zone of minimum section, and a length divergent from said zone, said zone of minimim section located substantially at said second end of said nozzle and forming, with said nozzle a gas outlet from said injection chamber for passage of entrainment gas into said diffuser; and (B) a metering device comprising:

(1) a flat-bottomed bowl fed continuously with said heat-decomposable powder at a constant level, said bowl maintained at atmospheric pressure and equipped with stirrer means, (2) a horizontal circular plate rotatably driven around its axis relative to the bowl, said plate having a planar upper face on which is formed a circular groove centered upon the axis of the plate, said plate being applied on its upper surface against a bottom portion of the bowl, wherein a seal having a low friction coefficient is inserted therebetween, said bowl being positioned off-center in relation to the plate, so that a portion of the length of said groove travels into the bowl while the remaining portion thereof remains on the outside of the bowl, and (3) a suction device having an orifice which extends to a point on said groove located outside the bowl, said suction device being connected to the input flow path of said powder ejector.

16. The pneumatic powder ejector of claim 15 wherein said powder is entrained in air along said input flow path and is supplied at a controlled delivery rate.

* * * * *